United States Patent [19]

Hayashi et al.

[11] Patent Number: 4,606,255

[45] Date of Patent: Aug. 19, 1986

[54] GUITAR FOR GUITAR SYNTHESIZER

[75] Inventors: Yoshiaki Hayashi; Akira Matsui, both of Matsumoto, Japan

[73] Assignee: Roland Corporation, Osaka, Japan

[21] Appl. No.: 655,326

[22] Filed: Sep. 26, 1984

Related U.S. Application Data

[63] Continuation-in-part of Ser. No. 484,881, Apr. 14, 1983, abandoned.

[30] Foreign Application Priority Data

May 6, 1982 [JP] Japan ..... 57-66215

[51] Int. Cl.[4] ..... G10H 3/18

[52] U.S. Cl. ..... 84/1.16; 84/267; 84/291; 84/293

[58] Field of Search ..... 84/1.16, 267, 291–293; D17/14, 15

[56] References Cited

U.S. PATENT DOCUMENTS

D. 26,424 12/1896 Livermore ..... D17/14
D. 207,877 6/1967 FitzGibbon ..... D17/14
518,775 4/1894 Birrer ..... 84/267
4,357,852 11/1982 Suenaga ..... 84/1.16

*Primary Examiner*—S. J. Witkowski
*Attorney, Agent, or Firm*—W. G. Fasse; D. H. Kane, Jr.

[57] ABSTRACT

A guitar synthesizer has a guitar body (10) and a synthesizer portion (20). The body (1) of the guitar extends toward a head (3) in a direction so that an end (11) serving as a first vibratory member in the body base to which a neck (2) is connected, intersects with the neck. A second end (13) serving as the second vibratory member may also intersect with the neck. A non-vibratory portion (12) is interposed between the first and the second vibratory members (11, 13). A reinforcing frame (4) is attached to the head and body to interconnect them with the shortest distance for providing a firm connection from the non-vibratory portion of the body to a part of the head closer to a nut (5) than to the head end. Thus, the connection between the head and the frame is located below the central point of the distance between the nut and the top end of the head. Such a structure suppresses vibrations of the neck and an early attenuation of the fundamental frequency due to the vibration of the strings (7), are avoided.

4 Claims, 2 Drawing Figures

GUITAR FOR GUITAR SYNTHESIZER

CROSS-REFERENCE TO RELATED APPLICATION

The present application is a continuation-in-part application of our copending U.S. patent application Ser. No. 484,881, filed on Apr. 14, 1983, and now abandoned.

BACKGROUND OF THE INVENTION

1. Field of the Invention

The present invention relates to a guitar for a guitar synthesizer. More specifically, the present invention relates to a guitar for a guitar synthesizer for generating a synthesized guitar sound based on the fundamental frequency detected by picking up a string vibration obtained by touching the strings of the guitar.

2. Description of the Prior Art

A typical conventional guitar synthesizer is disclosed for example in the U.S. Pat. No. 4,357,852, issued Nov. 9, 1982 to Noboru Suenaga and assigned to the same assignee as the present application. The above referenced patent is incorporated herein by reference. Such a guitar synthesizer picks up a string vibration obtained by touching the strings of a guitar to detect the fundamental frequency of the string vibration, by which a guitar sound is synthesized. For this reason, in such a guitar synthesizer, a fundamental frequency component needs to be provided more stably than in a conventional electric guitar.

A conventional guitar, electric guitar or in a guitar for guitar synthesizer has an elongated neck. As a result, by the vibration generated in the neck or the body through the influence of the strings vibrated in the performance of the guitar, two or three or more than three dead points are unavoidably generated in some musical intervals on the finger board of the neck. Even if such dead points are generated in a conventional guitar or electric guitar, vibration of the strings per se becomes a sound, which causes no problem because of the live performance.

However, in a guitar synthesizer, a sound generated by pressing a dead point is attenuated extraordinarily rapidly, whereby the sound is insufficiently sustained. Accordingly it may happen that the fundamental wave of the sound has died away rapidly and only the harmonics remain. Due to the phase deviation caused by the vibration in the frets between the fundamental wave component and a harmonic at the rise of the vibration of the strings, it may happen that the fundamental wave component has disappeared in and hence is no longer present. Furthermore, since the vibration waveform of the string is changed due to the above stated phase deviation, sometimes a fundamental wave cannot be extracted correctly.

In addition, it may happen that the vibration direction of the touched string changes under the influence of vibration of the neck or the body, causing a non-sensitive region where a sound signal is stopped due to the positional relation between the direction of the string vibration and the pickup. If a fundamental sound has died away rapidly, leaving only the harmonics, or if a sound signal from a pickup is stopped as described above, such a synthesizer would operate erroneously, causing an inconvenience in the performance.

Accordingly, a guitar having no dead point and causing no stop of a sound signal is desirable. For avoiding the above described disadvantages, a neck of a guitar might be made thick enough so as not to be vibrated easily. However, such approach for stopping the vibration of the neck results in a neck which is too thick making it difficult to press the finger board and accordingly such a guitar is impractical as a musical instrument. Another approach for damping vibrations, may involve shortening the guitar neck by positioning the junction of the neck and the body nearer to the head side of the neck without changing the distance between a nut and a bridge for supporting the strings, in other words without changing the length of the strings, namely the length of the finger board.

However, in such approach, if one wants to play the guitar by pressing the "high position", such a construction of the body would become an obstruction to proper performance. A further approach may be considered in which a reinforcement core made of steel, for example, is inserted in the interior of the guitar neck generally made of a light material. However, this approach also involves disadvantages that the neck becomes heavy, causing a bad balance of weight in the instrument. Another disadvantage of inserting a reinforcement into the neck is seen in that the inserting is difficult and hence the insertion may lower productivity and cause a high percentage of defective products. As a further approach, it may be considered that a weight is attached to the head at the top of the neck to make the head heavy so that the head portion cannot be vibrated easily. However, in order to prevent the vibration by this approach, a weight of at least 1 kg must be attached to the head and as a result, the weight balance of the guitar would be lost, causing difficulties in using such a guitar in a musical performance.

SUMMARY OF THE INVENTION

Therefore, a primary object of the present invention is to provide a guitar for a guitar synthesizer in which the strings can vibrate stably while an early attenuation of a fundamental wave based on the vibration of the strings is prevented.

Briefly stated, in the present invention, a non-vibratory portion near the base of a body to which a neck is attached, projects in a manner approaching a head and this projecting non-vibratory portion and the head are interconnected firmly, with the shortest distance, by a reinforcing frame.

Consequently, according to the present invention, the reinforcing frame has the function of preventing the head from being vibrated under the influence of vibrations of the strings and as a result, no dead point will be generated. Accordingly, attenuation of a musical sound will be made slowly and the sound vibration will have the desired long duration, in other words, a sustaining effect can be applied sufficiently. In addition, early attenuation of a fundamental wave component is prevented, since such prevention is indispensably necessary for the performance of a guitar synthesizer for obtaining musical sounds with the required full volume.

These objects and other objects, features, aspects and advantages of the present invention will become more apparent from the following detailed description of the present invention when taken in conjunction with the accompanying drawings.

DESCRIPTION OF THE PREFERRED EMBODIMENT AND OF THE BEST MODE OF THE INVENTION

Figure 1:
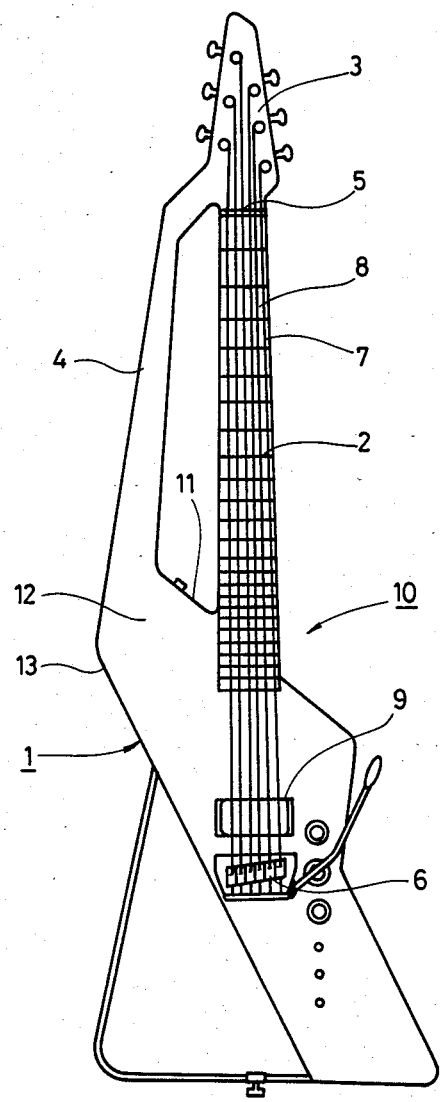
FIG. 1 shows the appearance of a guitar portion included in an embodiment of the present invention.

Referring to FIG. 1, an elongate neck 2 projects from a body 1. A nut 5 is provided in the junction portion between the top end of the neck 2 and a head 3, and a bridge 6 is provided in the body 1, so that strings 7 are stretched between the nut 5 and the bridge 6. In the body 1, a pickup 9 is provided for detecting vibration of the strings 7 to convert it into an electrical signal. This electrical signal is supplied to a synthesizer portion 20 shown in FIG. 2, to be described below.

An end portion 11 serving as the first vibratory member, is positioned in the base part of the body 1 to which the neck 2 is fixed. The vibratory member 11 intersects the neck 2 and extends in a direction relative to the head 3. An end portion 13 serving as the second vibratory member also intersects with the neck 2 and so that a non-vibratory portion 12 is interposed between the above described first vibratory end member 11 and the second vibratory end member 13. A reinforcing frame 4 is attached to the non-vibratory portion 12 of the body 1 and to the head 3 whereby the frame 4 extends between the body 1 and the head 3. The position for attachment of the reinforcing frame 4 to the head 3 is preferably selected to be a position nearer to the nut 5 and further away from the top end of the head 3. In a specific example for attachment of the reinforcing frame 4, depressed portions are provided respectively in the non-vibratory portion 12 of the body 1 and the head 3 and both ends of the reinforcing frame 4 are inserted in the respective depressed portions so as to be fixed by using screws or an adhesive agent. However, other suitable methods may be applied for attaching the reinforcing frame 4.

Though, the reinforcing frame 4 is thus fixed between the body 1 and the head 3, the intermediate portion of the reinforcing frame 4 is spaced from the neck 2. More specifically, at the time of performance of the guitar 10, the reinforcing frame 4 never becomes any obstruction to pressing of a finger board 8 provided on the neck 2, and as a result, no difficulty will be involved in handling of the musical instrument.

The above described reinforcing frame 4 serves to suppress the vibration of the neck 2 not only by its rigidity but also by the "mechanical feedback" of the vibration transmitted through the reinforcing frame 4. Accordingly, a material or a shape not having so high rigidity may be utilized for the reinforcing frame 4.

For example, in an experiment carried out by the inventors of the present invention, using an angle material of aluminum of the reinforcing frame 4, it was found that the vibration of the head 3 can be suppressed, generating no dead point, in spite of the vibration of the reinforcing frame 4 of aluminum. As a result, it can be easily understood that the vibration of the neck 2 is suppressed not only by the rigidity of the reinforcing frame 4 but also by cancellation of the vibration transmitted from the body 1 to the head 3 and the vibration transmitted oppositely from the head 3 to the body 1 through the reinforcing frame 4 by the vibration of the head 3 and the vibration of the body 1, respectively. As a material for the reinforcing frame 4, wood or a synthetic resin may be used instead of a metal and as for the shape thereof, a hollow pipe may be adopted.

Although in the above description, the reinforcing frame 4 was fixed to the body 1 and the head 3, the present invention is not limited to such structure, and the present invention may be implemented with a structure in which the reinforcing frame 4 and the neck 2 are formed as a unitary body so as to be attached to the body 1 or with a structure in which the reinforcing frame 4, the neck 2 and the body 1 are formed as a unitary body.

Although in the above described embodiment the reinforcing frame 4 was provided laterally along a longitudinal side of the neck 2, the reinforcing frame 4 may be provided along the bottom side of the neck 2.

Figure 2:
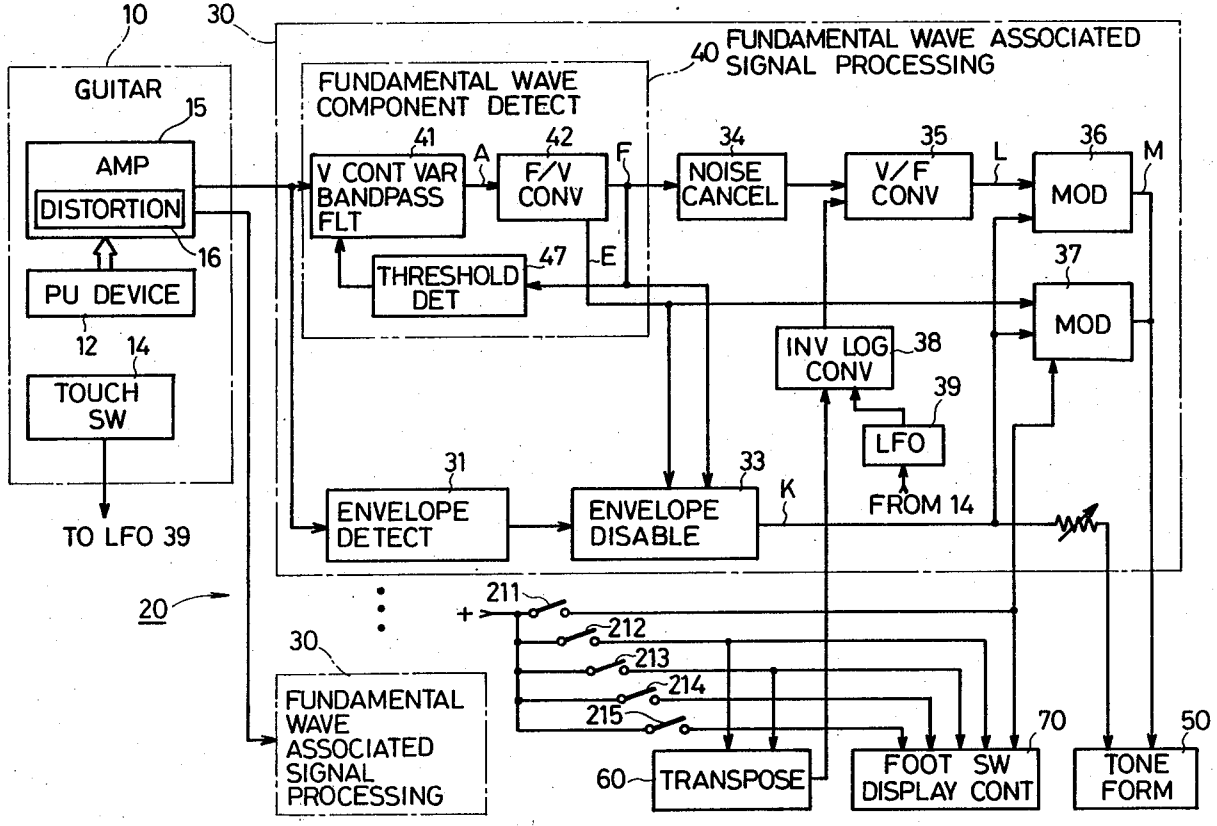
FIG. 2 PRIOR ART
FIG. 2 is a schematic block diagram of a guitar synthesizer known from the above discussed U.S. Pat. No. 4,357,852 and suitable for use in an embodiment of the present invention.

FIG. 2 is a conventional block diagram of for use in guitar synthesizer of an embodiment of the present invention. The guitar portion 10 comprises a pickup device 12, a touch switch 14 and an amplifier 15. The amplifier 15 serves to amplify the guitar string signals obtained in response to the string vibration of the respective strings detected by the pickups of the pickup device 12 and to provide the respective outputs to the synthesizer portion 20. The amplifier 15 comprises a distortion adding circuit 16. The distortion adding circuit 16 is used to apply a desired distortion effect to the guitar string signals as picked up, thereby to provide guitar string signals of different tones.

The synthesizer portion 20 comprises six fundamental wave associated signal processing circuits 30, each for extracting a fundamental wave component from a guitar string note signal for each string for synthesization of a guitar sound with an envelope signal generated on the basis of the guitar string signal.

In FIG. 2, only one fundamental wave associated signal processing circuit 30 for one string is illustrated in detail, while the remaining fundamental wave associated signal processing circuits 30 are shown in a simplified manner, for simplicity of illustration.

The fundamental wave associated signal processing circuit 30 comprises a fundamental wave component detecting circuit 40, which serves to extract a fundamental wave component from a guitar string signal including harmonics as well as a fundamental wave component obtained from the amplifier 15 and to generate a fundamental wave associated signal E in a sawtooth wave form having the same frequency as that of the fundamental wave component and a voltage signal F associated with the frequency or pitch of the fundamental wave component. For the above described purposes, the fundamental wave component detecting circuit 40 comprises a voltage controlled variable bandpass filter 41, a frequency/voltage converting circuit 42 and a threshold detecting circuit 47. The voltage controlled variable bandpass filter 41 is responsive to a control voltage provided from the threshold determining circuit 47 to exhibit a variable passband characteristic variable in higher and lower frequency regions of the frequencies of the fundamental wave component. The frequency/voltage converting circuit 42 serves to convert the frequency of the output of the voltage controlled bandpass filter 41 into a voltage signal F associated with the frequency and also to provide a fundamental wave associated signal E in a sawtooth waveform having the same frequency as that of the fundamental wave component. The threshold determining circuit 47 serves to threshold detect the above described frequency associated voltage F to provide a control voltage to the voltage controlled variable bandpass filter 41. By thus structuring the fundamental wave component detecting circuit 40, the passband characteristics of the voltage controlled variable bandpass filter 41 is suitably variable within the frequency range of the fundamental wave component extracted from a guitar string signal, as a function of the voltage associated with the frequency of the output of the filter 41, whereby the fundamental wave component is extracted from the guitar string signal with accuracy.

The output voltage F associated with the frequency or pitch of the fundamental wave component of the output of the fundamental wave component detecting circuit 40 undergoes noise removal by a noise canceling circuit 34, whereupon the output thereof is applied to a voltage/frequency converting circuit 35. The voltage/-frequency converting circuit 35 generates, through conversion, another fundamental wave associated signal or another sound source signal having a frequency corresponding to the frequency associated with the frequency associated voltage F, and thus to the frequency or pitch of the fundamental wave component extracted from the guitar string signal. The sound source signal from the voltage/frequency converting circuit 35 is applied to a modulating circuit 36.

The fundamental wave associated signal processing circuit 30 comprises an envelope detecting circuit 31 for detecting an envelope of the guitar string signal to generate an envelope signal K representing the envelope of the guitar string signal. The envelope signal K detected by the envelope detecting circuit 31 is applied to the modulating circuit 36 through an envelope disabling circuit 33. The envelope disabling circuit 33 is responsive to an abrupt variation of the frequency of the fundamental wave component to disable the envelope detecting circuit 31, thereby to disable the generation of the envelope signal K. The modulating circuit 36 modulates the sound source signal based on the envelope signal K. The fundamental wave associated signal E having the same frequency as the fundamental wave component obtained from the fundamental wave detecting circuit 40 and the envelope signal K obtained from the envelope detecting circuit 31 are applied to another modulating circuit 37, which modulates the fundamental wave associated signal E base on the envelope signal K. The modulated outputs of the modulating circuits 36 and 37 respectively are applied to a tone forming circuit 50.

The synthesizer portion 20 further comprises foot switches 211 to 215, at transpose circuit 60 and a foot switch display control circuit 70. The foot switch 211 serves to generate a duet effect and the foot switches 212 to 215 serve to shift the pitch of a tone at the time of generating a sweep effect. Now, a duet effect will be described. As the duet effect, a performance sound is generated in a duet manner through synthesization of the fundamental wave associated signal L obtained in response to each preceding cycle of the fundamental wave component included in the guitar string signal and the fundamental wave associated signal E obtained in response to each succeeding cycle of the fundamental wave component included in the guitar string signal. In response to depression of the foot switch 211, the modulating circuit 37 is enabled. Then, the modulating circuit 37 modulates the fundamental wave associated signal E in a sawtooth waveform with the envelope signal K. The modulated output from the modulating circuit 36 and the modulated output from the modulating circuit 37 are synthesized and applied to the tone forming circuit 50, whereby a duet effect sound is generated.

In case of generating a sweep effect, the transpose circuit 60 is responsive to depression of the foot switches 212 and 213 to provide a voltage signal for changing the pitch of the synthesized sound. The pitch changing voltage signal is applied to an inverse logarithmic converting circuit 38. The inverse logarithmic converting circuit 38 serves to change the output voltage of the transpose circuit 60 in an inverse logarithmic functional manner, thereby to provide the output to the voltage/frequency converting circuit 35 as a function of the frequency controlling voltage. As a result, the frequency of the output of the voltage/frequency converting circuit 35 is changed smoothly in a sweep effect performance.

Thus, the synthesized guitar sound can be generated from the synthesizer portion 20. As described above, if the fundamental wave component is not correctly included in the guitar string signal obtained from the guitar portion 10, the fundamental wave associated signal processing circuit 30 cannot extract the fundamental wave component with accuracy from a guitar string note signal, causing erroneous operation. However, in accordance with the present invention, since the reinforcing frame 4 is provided in the guitar portion 10, early attenuation of the fundamental wave component of the string vibration can be prevented and rich musical sounds can be obtained from the synthesizer portion 20.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A guitar synthesizer, comprising a guitar body, a bridge provided on the upper surface of said body, a neck having one end attached to said body, a nut and a head provided in the top end portion of said neck, strings stretched between said bridge and said nut, and a pickup for providing a guitar string signal including a fundamental frequency component according to the vibration of each of said strings and a harmonic frequency component thereof; and synthesizer means for generating a guitar synthetizer signal associated with said fundamental frequency component in response to said guitar string signal, said body of said guitar comprising projecting means (11, 12, 13) including a non-vibratory projecting portion (12) located in the vicinity from which said neck extends toward said head, and a mechanical reinforcing frame (4) extending from said non-vibratory projecting portion of said body toward said head, said mechanical reinforcing frame (4) firmly connecting said body and said head along the shortest distance for suppressing vibrations of said neck to prevent an early attenuation of said fundamental frequency component, and wherein said projecting means have two vibratory portions (11, 13), at least one of which intersects with said neck, said non-vibratory projecting portion (12) of said body extending between said vibratory portions in a direction permitting said mechanical reinforcing frame member (4) to extend toward said head.

2. The guitar synthesizer of claim 1, wherein said reinforcing frame is connected between said non-vibratory projecting portion (12) of said body and a head portion located closer to said nut than to the top end of said head.

3. The guitar synthesizer of claim 1, wherein said reinforcing frame and said neck are integrally structured as a unitary body.

4. The guitar synthesizer of claim 1, wherein said reinforcing frame, said neck and said body are integrally structured as a unitary body.

* * * * *